US009161142B1

(12) United States Patent
Wagner

(10) Patent No.: US 9,161,142 B1
(45) Date of Patent: Oct. 13, 2015

(54) PUSH BUTTON INSERTION TOOL SYSTEMS

(71) Applicant: Dennis Wagner, Nescopeck, PA (US)

(72) Inventor: Dennis Wagner, Nescopeck, PA (US)

( * ) Notice: Subject to any disclaimer, the term of this patent is extended or adjusted under 35 U.S.C. 154(b) by 260 days.

(21) Appl. No.: 13/685,712

(22) Filed: Nov. 27, 2012

Related U.S. Application Data

(60) Provisional application No. 61/587,183, filed on Jan. 17, 2012.

(51) Int. Cl.
*H04R 25/00* (2006.01)

(52) U.S. Cl.
CPC ..... *H04R 25/65* (2013.01)

(58) Field of Classification Search
CPC ..... H04R 25/00; H04R 25/654
See application file for complete search history.

(56) References Cited

U.S. PATENT DOCUMENTS

| | | | | |
|---|---|---|---|---|
| 7,388,961 | B2 | 6/2008 | Shennib et al. | |
| 7,443,993 | B2 | 10/2008 | Gunnersen et al. | |
| 8,184,842 | B2 | 5/2012 | Howard et al. | |
| 2009/0285428 | A1 | 11/2009 | Gilgert | |
| 2010/0098477 | A1* | 4/2010 | Lee | 401/103 |
| 2011/0009877 | A1 | 1/2011 | Thenuwara et al. | |
| 2011/0206225 | A1 | 8/2011 | Møller et al. | |

* cited by examiner

*Primary Examiner* — Duc Nguyen
*Assistant Examiner* — Taunya McCarty
(74) *Attorney, Agent, or Firm* — RG Patent Consulting, LLC; Rachel Gilboy

(57) ABSTRACT

Push button insertion tool is a device used to help clean and install a receiver-in-the-canal hearing instrument into the ear. This product may be in the shape of a tapered tube, resembling a writing pen. The far end of the tube may be shaped to fit receivers of various sizes, and may include a slot on the side through which the microphone wire may extend. On the other end of the tube may be a push button. When pushed, it moves a rod through the tube to a push plunger, which inserts the receiver out of the tube and into the ear canal. A return spring and guide pin on the far end is designed to retract the push rod back to starting position.

17 Claims, 5 Drawing Sheets

PUSH BUTTON INSERTION TOOL SYSTEMS

CROSS-REFERENCE TO RELATED APPLICATION

The present application is related to and claims priority from prior provisional application Ser. No. 61/587,183, filed Jan. 17, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of tools for insertion and more specifically relates to a push button insertion tool for use with hearing aids.

DESCRIPTION OF THE RELATED ART

Many individuals wear hearing aids to amplify their hearing and thus improve communication. A hearing aid is typically an electroacoustic device which typically fits in or behind the wearer's ear, and is designed to amplify and modulate sound for the wearer, yet remain somewhat concealed from view. There are many different forms of hearing aids including body worn aids, those for connection behind the ear or in the ear, receiver in the canal versions and others. BTE (behind the ear) hearing instruments that place the loudspeaker directly in the ear without a fitted earmold are often referred to as "Receiver in the Canal" instruments. These instruments use soft ear inserts, typically of silicone, to position the loudspeaker in the patient's ear. Some of the advantages with this approach include improved sound quality, reduced case size, 'open-fit' technology, and immediate patient fitting.

In-the-ear hearing aids are small, which may be a distinct advantage; however the relative size and shape may prove difficult for individuals to manage, especially those with large hands or arthritis or other similar conditions. This may make insertion into the ear difficult. When cleaning, it can be difficult for an individual to hold onto the small piece of equipment, increasing the risk of dropping it or losing it. Individuals may incur the extra expense of replacing hearing aids because they were lost or damaged in some way due to difficulty in handling them. Instead of cleaning regularly, individuals who struggle to handle small hearing aids may simply go without, potentially risking their hearing and health of the ear; also often leaving them out of communication with others. An effective solution is desirable.

Various attempts have been made to solve the above-mentioned problems such as those found in U.S. patent and Pub. Nos. 2009/0285428; 2011/0009877; U.S. Pat. No. 8,184,842; 2011/0206225; U.S. Pat. No. 7,388,961; and U.S. Pat. No. 7,443,993. This art is representative of hearing aid assist devices. None of the above inventions and patents, taken either singly or in combination, is seen to describe the invention as claimed.

Ideally, a push button insertion tool should be user-friendly for all users and, yet would operate reliably and be manufactured at a modest expense. Thus, a need exists for a reliable push button insertion tool system to avoid the above-mentioned problems.

BRIEF SUMMARY OF THE INVENTION

In view of the foregoing disadvantages inherent in the known hearing aid insertion means art, the present invention provides a novel push button insertion tool system. The general purpose of the present invention, which will be described subsequently in greater detail is to provide an efficient and effective means whereby users can safely insert a receiver-in-the-canal hearing instrument into the ear canal.

Push button insertion tool makes it easy and convenient to insert a receiver-in-the-canal hearing instrument into the ear canal. This product is especially desirable for individuals with large hands who have trouble gripping a small instrument, or for individuals with arthritis, Parkinson's or a similar condition(s) that prevents them from being able to deftly handle small objects. This product allows an individual to keep better track of their expensive equipment without fear of dropping or losing the individual pieces. This product increases the overall health of the ear by allowing an individual to maintain regular cleaning, and thus increases the quality of hearing a person can experience as a result. Virtually anyone who wears an in-the-canal hearing instrument may benefit from this convenient product.

A push button insertion tool system is disclosed herein, in a preferred embodiment, comprising: an insertion assembly including an inserter body (having a tubular body, an outer shell comprising a hollow interior volume; a proximate end with a lip; a distal end; a slot; and a clip member); a spring assembly having a push-button; a first plunger; a rod; a spring; a second plunger; and a guide pin. The guide pin preferably operates in combination with the spring for guiding the rod when retracting (for storage purposes) and advancing (for insertion purposes). Certain embodiments may not comprise a guide pin.

Insertion assembly comprises inserter body and spring assembly in combination, the spring assembly housed by inserter body. The inserter body preferably comprises the tubular body having a proximate end and a distal end (located on opposing terminal-ends of the tubular body). A slot is located on the distal end of the tubular body. The slot comprises a vertical-slot that runs perpendicular to a receiver-dispenser aperture and allows a microphone wire to extend therefrom for insertion (such that the wire doesn't impede the travel of the receiver-in-the-canal hearing instrument as it progresses when being inserted). The distal end terminates in a receiver-dispenser aperture; the tubular body thus comprises a channel for guiding the receiver-in-the-canal hearing instrument to be inserted into an ear canal via a linear mechanical movement.

Further, the receiver-in-the-canal hearing instrument is able to be substantially isolated from contamination by of hands of a user before the receiver-in-the-canal hearing instrument is inserted into the ear canal, in fact the receiver-in-the-canal hearing instrument need not be touched during insertion and can be sanitized first (prior to engagement with the present invention) to help avoid spread of germs, contaminants that may be found on hands, in this way promoting ear health in its users.

The tubular body nearest the distal end preferably comprises a gentle taper; wherein the taper is contoured to substantially match the ear canal. In preferred embodiments the receiver-dispenser aperture is about ⅜ inch wide; the tubular body comprises a body-length of about 5 inches; the rod also comprises a rod-length of about 5 inches with a diameter of about ⅛ inch. The rod is preferably solid and cylindrical for ease of manufacturing and for cost and durability considerations. The proximate end comprises a through-hole; the push-button is depressible through the through-hole (similar to the operation of a pen), the push-button is suitably constrained within inserter body via the lip preventing it from uncoupling from the spring assembly (falling out and away from it).

The hollow interior volume comprises and contains (mostly encloses) the first plunger, the rod, the spring, and the second plunger; the push-button is depressible (from outside the hollow interior volume) to initiate a mechanical series reaction: from the push-button to the first plunger to the rod, the first plunger pushing rod, the rod compressing the spring, the spring compressed used to move the second plunger towards the receiver-dispenser aperture in the distal end to dispense the receiver-in-the-canal hearing instrument therefrom. The second plunger temporarily holds the receiver-in-the-canal hearing instrument and inserts it into the ear canal through the receiver-dispenser aperture when the push-button is depressed. The push-button when released allows the spring to return to a tension state allowing the second plunger, the rod, the first plunger to travel back towards the proximate end after the receiver-in-the-canal hearing instrument is inserted into the ear canal; and thus the insertion assembly is useful to allow a user to insert the receiver-in-the-canal hearing instrument into the ear canal in a controlled fashion.

A method of using a push button insertion tool is also disclosed herein preferably comprising the steps of: placing a receiver-in-the-canal hearing instrument into (contact with) a second plunger; (partially) inserting an inserter body into an ear canal; depressing a push-button to push a first plunger, a rod, compress a spring and push a second plunger in series, the second plunger holding the receiver-in-the-canal hearing instrument; and inserting the receiver-in-the-canal hearing instrument into the ear canal. The method may further comprise the step of draping the microphone wire through a slot in the tubular body. Further, the method may further comprise the step of sanitizing the receiver-in-the-canal hearing instrument before the placing step.

The present invention holds significant improvements and serves as a push button insertion tool system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, push button insertion tool, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a push button insertion tool system and more particularly to a push button insertion tool as used to improve the efficiency, effectiveness and user-friendliness for insertion of a receiver-in-the-canal hearing instrument into the ear, even by those users who do not have good dexterity.

Generally speaking, push button insertion tool of the present invention comprises a device used to help clean and install a (clean) receiver-in-the-canal hearing instrument into the ear. This product may be in the shape of a tapered tube, resembling a writing pen. The far end of the tube may be shaped to fit receivers of various sizes, and may include a slot on the side through which the microphone wire may extend. On the other end of the tube may be a push button, similar to the 'click button' of a pen. When pushed, it moves a rod through the tube to a push plunger, which inserts the receiver out of the tube and into the ear canal. A return spring and guide pin may be used on the far end to retract the push rod back to starting position. This product may be constructed from plastic, nylon, PVC or a similar suitable material. This tool may be an approximately ⅜" tapered tube approximately 5" long. The inner push rod may be ⅛" wide and 5" long. The device is held substantially parallel to the ear canal for insertion and may be stored vertically using a clip or horizontally if set on a surface.

Figure 1:
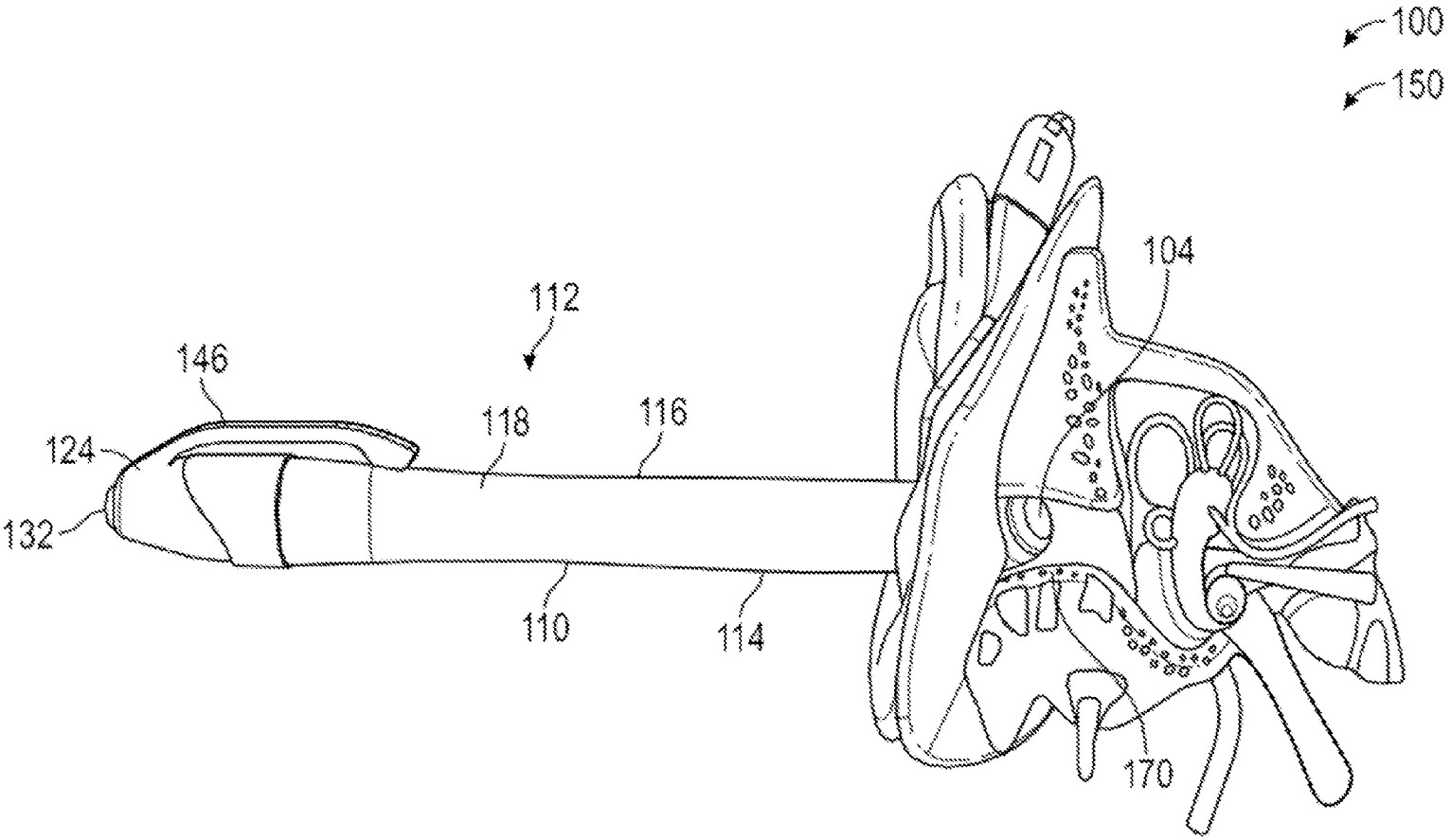
FIG. 1 shows a side view illustrating a push button insertion tool in an in-use condition being used to insert a receiver-in-the-canal hearing instrument into an ear canal according to an embodiment of the present invention.

Referring to the drawings by numerals of reference there is shown in FIG. 1, a side view illustrating push button insertion tool 110 in in-use condition 150 being used to insert receiver-in-the-canal hearing instrument 104 into ear canal 170 according to an embodiment of the present invention. Insertion is also shown in FIG. 4A.

Push button insertion tool system 100 comprises: insertion assembly 112 including inserter body 114 (having tubular body 116 comprising hollow interior volume 118; proximate end 120 with lip 124; distal end 122; and slot 126). Insertion assembly 112 also comprises spring assembly 130 having push-button 132; first plunger 134; rod 136; spring 138; and second plunger 140. In this way insertion assembly 112 comprises inserter body 114 and spring assembly 130 in combination; spring assembly 130 housed by inserter body 114.

Inserter body 114 comprises tubular body 116 having proximate end 120 and distal end 122 (on opposing ends of tubular body 116), as previously mentioned; wherein slot 126 is located on distal end 122 of tubular body 116. Distal end 122 terminates in receiver-dispenser aperture 128 and proximate end 120 comprises through-hole 142 (the length therethrough being hollow as hollow interior volume 118). Distal end 122 is the end used to come into contact with the ear of the user. Push-button 132 (at proximate end 120) is depressible through through-hole 142; push-button 132 is suitably constrained from uncoupling from spring assembly 130 within inserter body 114 via lip 124. Hollow interior volume 118 comprises and contains first plunger 134, rod 136, spring 138, and second plunger 140 (respectively from proximate end 120 to distal end 122). Push-button 132 is depressible to initiate a mechanical series reaction from push-button 132 to first plunger 134 to rod 136, first plunger 134 pushing rod 136, rod 136 compressing spring 138, spring 138 compressed to move second plunger 140 towards receiver-dispenser aperture 128 in distal end 122 (shown in FIG. 4A). Mechanical movement is propagated in this way using the present invention.

Second plunger 140 temporarily holds receiver-in-the-canal hearing instrument 104 and inserts it into ear canal 170 through receiver-dispenser aperture 128 when push-button 110 is depressed. Push-button 110 when released allows spring 138 to return to a tension state allowing second plunger 140, rod 136, and first plunger 134 to travel back towards proximate end 120 (reverse operation as to insertion travel) after receiver-in-the-canal hearing instrument 104 is inserted into ear canal 170. As such insertion assembly 112 is useful to allow a user to insert receiver-in-the-canal hearing instrument 104 into ear canal 170 in a controlled fashion. Insertion assembly 112 of push button insertion tool system 100 may further comprise guide pin 144 in certain embodiments.

Figure 2:
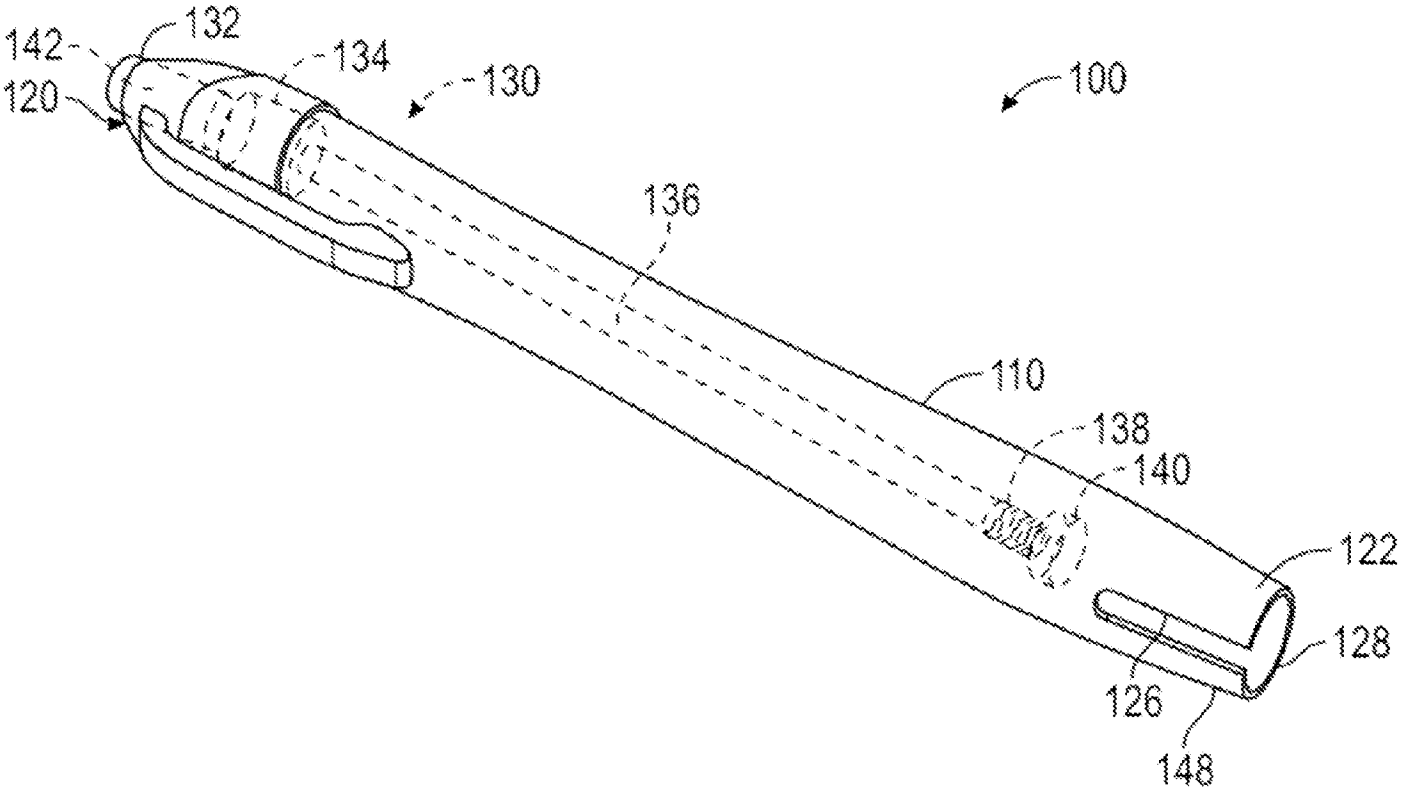
FIG. 2 is a perspective view illustrating the push button insertion tool according to an embodiment of the present invention of FIG. 1.

Referring now to FIG. 2, a perspective view illustrating push button insertion tool 110 according to an embodiment of the present invention of FIG. 1.

Figure 3:
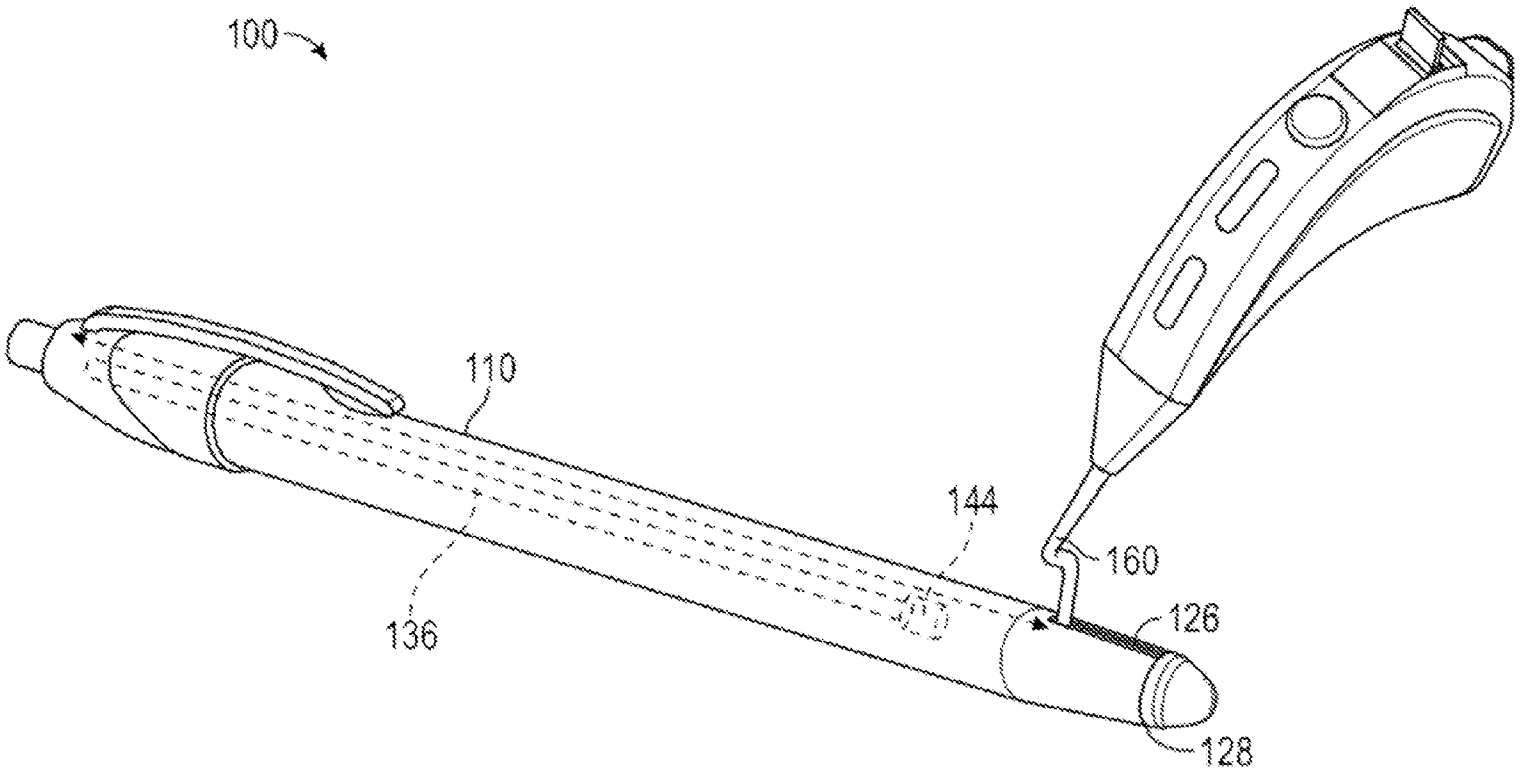
FIG. 3 is a perspective view illustrating the push button insertion tool as connected to the receiver-in-the-canal hearing instrument ready for insertion according to an embodiment of the present invention of FIG. 1.

Push button insertion tool system 100 may further comprise clip member 146, such that the device can be attached to clothing pockets or the like for convenience of the user. Inserter body 114, as previously mentioned comprises tubular body 116 having slot 126; slot 126 comprises a vertical-slot that runs perpendicular to receiver-dispenser aperture 128 (parallel to tubular body 116) and allows microphone wire 160 to extend therefrom as also shown in FIG. 3. The feature of using slot 126 allows receiver-in-the-canal hearing instrument 104 to travel unimpeded such that it is kept parallel to tubular body 116 during the insertion process.

Tubular body 116 nearest distal end 122 comprises taper 148. Taper 148 is contoured to match ear canal 170 to make the device easy to use. Receiver-dispenser aperture 128 is about ⅜ inch wide in preferred embodiments. Receiver-dispenser aperture 128 may also be greater or less than about ⅜ inch wide in alternate embodiments to accommodate different sized receiver-in-the-canal hearing instruments 104. Rod 136 preferably comprises a length of about 5 inches. Rod 136 preferably comprises a diameter of about ⅛ inch. Rod 136 is preferably solid so as to provide suitable durability. Rod 136 may be cylindrical. Sizes and shapes may be altered to suit application and preference and yet remain within the scope of this disclosure.

Referring now to FIG. 3, a perspective view illustrating push button insertion tool 110 as connected to receiver-in-the-canal hearing instrument 104 ready for insertion according to an embodiment of the present invention of FIG. 1.

Receiver-in-the-canal hearing instrument 104 is able to be substantially isolated from contamination of hands of the user before receiver-in-the-canal hearing instrument 104 is inserted into ear canal 170. As mentioned previously receiver-in-the-canal hearing instrument 104 may be inserted using the present invention in a safe and sanitary manner. Method of use 500 is shown and discussed subsequently.

Figure 4B:
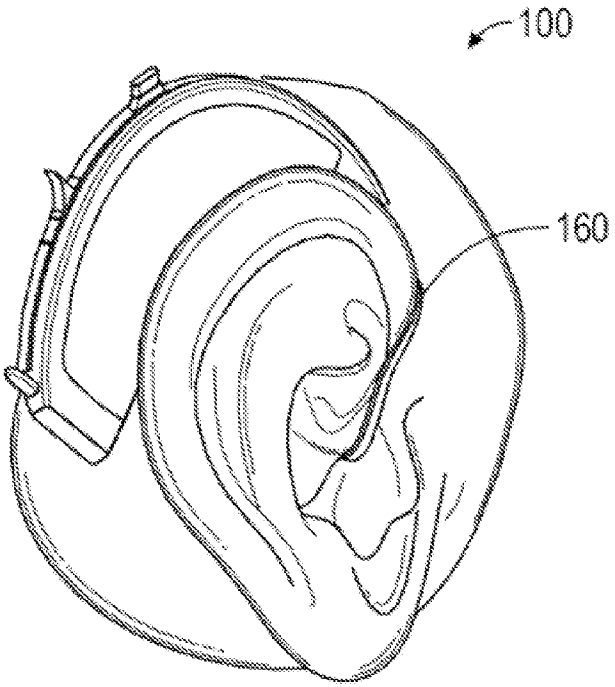
FIG. 4B is a perspective view illustrating the receiver-in-the-canal hearing instrument as inserted into the ear canal (ready for use) according to an embodiment of the present invention of FIGS. 1-4A.
Figure 4A:
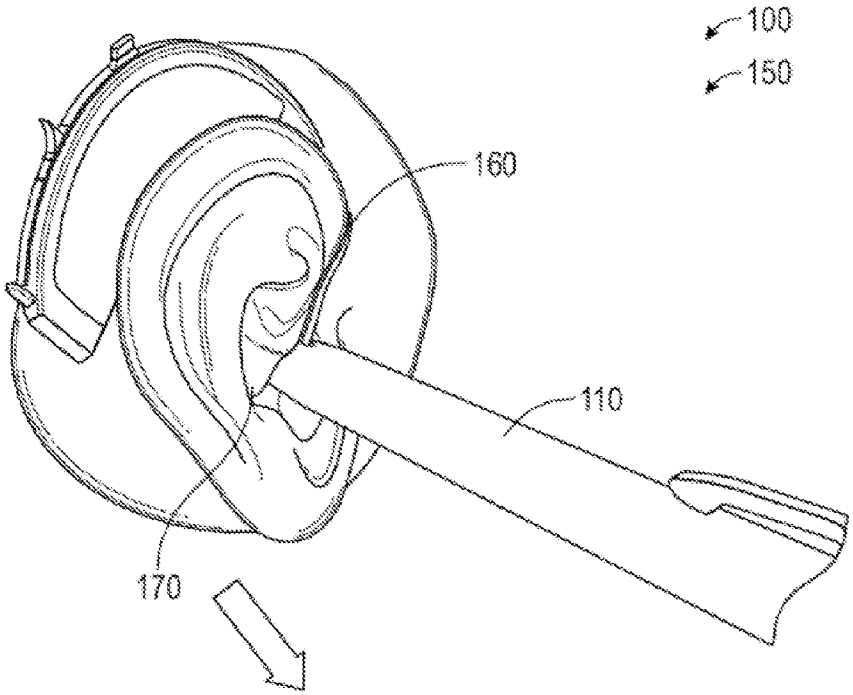
FIG. 4A is a perspective view illustrating the push button insertion tool inserting the receiver-in-the-canal hearing instrument into the ear canal according to an embodiment of the present invention of FIGS. 1-3.

Referring now to both FIGS. 4A and 4B; FIG. 4A, shows a perspective view illustrating push button insertion tool 110 inserting receiver-in-the-canal hearing instrument 104 into ear canal 170 according to an embodiment of the present invention of FIGS. 1-3, and FIG. 4B is a perspective view illustrating receiver-in-the-canal hearing instrument 104 as inserted into ear canal 170 (ready for use) according to an embodiment of the present invention of FIGS. 1-4A. Tubular body 116 comprises a channel for guiding receiver-in-the-canal hearing instrument 104 to be inserted into ear canal 170 via a linear mechanical movement. Taper 148 is contoured to match ear canal 170, as shown in FIGS. 1 and 4A.

Figure 5:
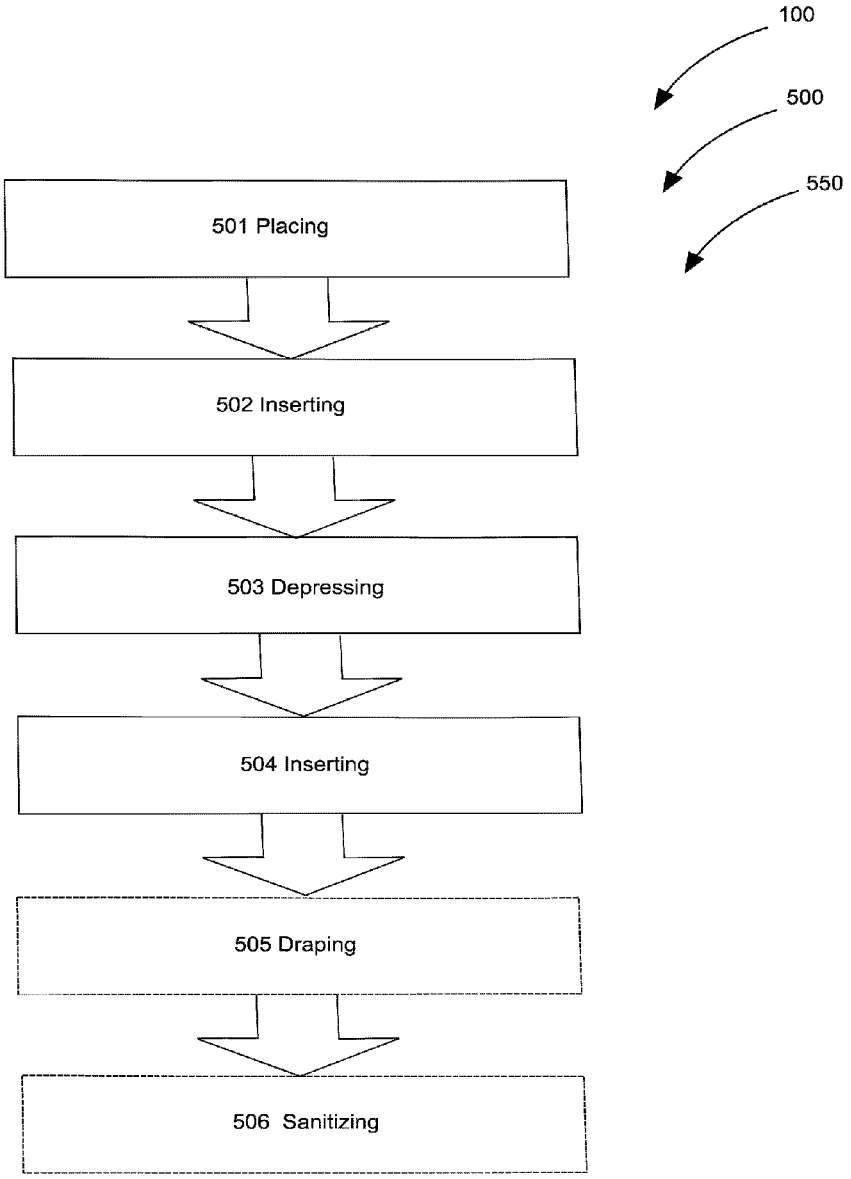
FIG. 5 is a flowchart illustrating a method of use for the push button insertion tool according to an embodiment of the present invention of FIGS. 1-4B.

Referring now to FIG. 5, flowchart 550 illustrating a method of use 500 for push button insertion tool 110 according to an embodiment of the present invention of FIGS. 1-4B.

A method of using (method of use 500) push button insertion tool 110 comprises the steps of: step one 501 placing receiver-in-the-canal hearing instrument 104 into second plunger 140; step two 502 inserting inserter body 114 (partially) into ear canal 170; step three 503 depressing push-button 132 to push first plunger 134, rod 136, compress spring 138 and push second plunger 140 in series, (second plunger 140 holding receiver-in-the-canal hearing instrument 104); and step four 504 inserting receiver-in-the-canal hearing instrument 104 into ear canal 170. The device is removed from contact with the ear at this point and stored for future use. The method 500 may further comprise the step five 505 of draping a microphone wire 160 through slot 126 in tubular body 116. Optionally, method 500 may further comprise the step six 506 of sanitizing receiver-in-the-canal hearing instrument 104 before the placing step (step one 501).

It should be noted that steps 505 and 506 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A push button insertion tool system comprising:

a) an insertion assembly including;

i) an inserter body having:

(1) an ear-canal-shaped body comprising an interior volume;

(2) a proximate end with an annular push-button-restraining-lip;

(3) a distal end; and (4) a linear-semicircular-cross-sectioned-microphone-wire-inserter-slot;

ii) a spring assembly having:

(1) a push-button;

(2) a truncated-conical-rod-push-plunger;

(3) a rod;

(4) a rod-spring-guide-pin (5) a return-coil-spring; and (6) a receiver-dispenser-plunger;

iii) a pocket-storage-clip; and iv) a receiver-in-the-canal-hearing-instrument having:

(1) a microphone wire;

b) wherein said interior volume of said ear-canal-shaped body does not fully enclose said first truncated-conical-rod-push-plunger;

c) wherein said rod-spring-guide-pin is linearly structured and arranged with said return-coil-spring such that an end of said rod-spring-guide-pin and an end of said return-coil-spring are co-terminus and further structured and arranged such that an inner-diameter of said rod-spring-guide-pin is larger than largest diameter of said rod-spring-guide-pin thereby enabling said rod-spring-guide-pin to longitudinally-travel within said return-coil-spring for guiding said rod, said rod having its largest diameter less than said inner-diameter of said rod-spring-guide-pin, and said rod-spring-guide-pin further structured and arranged for linearly guiding said receiver-in-the-canal-hearing-instrument into an ear canal of a user of said receiver-in-the-canal-hearing-instrument;

d) wherein said pocket-storage-clip is structured and arranged with an end of ear-canal-shaped body that holds said first truncated-conical-rod-push-plunger and is further structured and arranged to clip onto at least one pocket to store said push button insertion tool system in the at least one pocket;

e) wherein said insertion assembly comprises, in combination, said inserter body, said pocket-storage-clip, said receiver-in-the-canal-hearing-instrument, and said spring assembly, when said spring assembly is housed fully within said inserter body;

f) wherein said inserter body comprises said ear-canal-shaped body having said proximate end and said distal end on opposing terminal-ends of said ear-canal-shaped body and said linear-semicircular-cross-sectioned-microphone-wire-inserter-slot;

g) wherein said linear-semicircular-cross-sectioned-microphone-wire-inserter-slot is located on said distal end of said ear-canal-shaped body and terminates at said distal end of said ear-canal-shaped body and is sized to fully contain said microphone wire;

h) wherein said distal end terminates in a receiver-dispenser aperture and is structured and arranged with a first through-hole structured and arranged for clearance fit of outer dimensions of said receiver-in-the-canal-hearing-instrument when central axis of said first through-hole is aligned with a central axis of said receiver-in-the-canal-hearing-instrument;

i) wherein said proximate end comprises a second through-hole;

j) wherein said push-button is depressible into said second through-hole, said pushbutton is structured and arranged with a larger diameter than an inner diameter of said annular push-button-restraining-lip such that said push-button is constrained from uncoupling from said spring assembly within said inserter body via said annular push-button-restraining-lip;

k) wherein said interior volume comprises and contains said first truncated-conical-rod-push-plunger that is in direct contact with said rod that is in direct contact with said return-coil-spring that is in direct contact with said second receiver-dispenser-plunger that is in direct contact with said receiver-in-the-canal-hearing-instrument and wherein said ear-canal-shaped body is structured and arranged to contain only a portion of said first truncated-conical-rod-push-plunger all of said rod said return-coil-spring all of said second receiver-dispenser-plunger and all of said receiver-in-the-canal-hearing-instrument in a single axial configuration;

l) wherein said push-button is structured and arranged serially in following order with said first truncated-conical-rod-push-plunger said rod said return-coil-spring said second receiver-dispenser-plunger and said receiver-in-the-canal-hearing-instrument to initiate a mechanical series reaction from said push-button to said first truncated-conical-rod-push-plunger to said rod, said first truncated-conical-rod-push-plunger pushing said rod, said rod compressing said return-coil-spring, said return-coil-spring compressed to move said second receiver-dispenser-plunger towards said receiver-dispenser aperture in said distal end;

m) wherein said second receiver-dispenser-plunger is cylindrical and is structured and arranged within said ear-canal-shaped body to position said receiver-in-the-canal hearing instrument and is further structured and arranged with said interior volume to linearly move said receiver-in-the-canal-hearing-instrument from said interior volume through said receiver-dispenser aperture to into said ear canal only after said insertion assembly is inserted into said ear canal and said push-button is depressed; and n) wherein said push-button and said interior volume is structured and arranged linearly with said first truncated-conical-rod-push-plunger said rod said return-coil-spring said second receiver-dispenser-plunger and said receiver-in-the-canal-hearing-instrument and further structured and arranged with said ear-canal-shaped body to draw said microphone wire into said ear canal and release said microphone wire and said receiver-in-the-canal-hearing-instrument while said receiver-in-the-canal-hearing-instrument is within said ear canal and is further structured and arranged to return said return-coil-spring to a lesser-tension state and returning said second receiver-dispenser-plunger, said rod, said first truncated-conical-rod-push-plunger to travel back towards said proximate end after said receiver-in-the-canal hearing instrument is inserted into the ear canal.

2. The push button insertion tool system of claim 1 wherein said linear-semicircular-cross-sectioned-microphone-wire-inserter-slot comprises a linear-slot that runs perpendicular to said receiver-dispenser aperture and allows said microphone wire to extend therefrom.

3. The push button insertion tool system of claim 2 wherein said ear-canal-shaped body comprises a channel for guiding inserting of said receiver-in-the-canal hearing instrument into the ear canal via a linear mechanical movement initiated by the user pushing said push-button.

4. The push button insertion tool system of claim 3 wherein said receiver-in-the-canal hearing instrument is substantially physically sheltered from contamination of hands of the user by structure and arrangement of said ear-canal-shaped body partially enclosing said receiver-in-the-canal hearing instrument.

5. The push button insertion tool system of claim 4 wherein said ear-canal-shaped body nearest said distal end comprises a taper.

6. The push button insertion tool system of claim 5 wherein said taper is contoured to match said ear canal.

7. The push button insertion tool system of claim 6 wherein said receiver-dispenser aperture is about ⅜ inch wide.

8. The push button insertion tool system of claim 6 wherein said receiver-dispenser aperture is greater than about ⅜ inch wide.

9. The push button insertion tool system of claim 6 wherein said receiver-dispenser aperture is less than about ⅜ inch wide.

10. The push button insertion tool system of claim 7 wherein said ear-canal-shaped body comprises a length of about 5 inches.

11. The push button insertion tool system of claim 10 wherein said rod comprises a length of about 5 inches.

12. The push button insertion tool system of claim 11 wherein said rod comprises a diameter of about ⅛ inch.

13. The push button insertion tool system of claim 12 wherein said rod is solid.

14. A push button insertion tool system comprising:

a) an insertion assembly including;

i) an inserter body having;

(1) an ear-canal-shaped body comprising a interior volume;

(2) a proximate end with an annular push-button-restraining-lip;

(3) a distal end;

(4) a linear-semicircular-cross-sectioned-microphone-wire-inserter-slot; and (5) a pocket-storage-clip member;

ii) a spring assembly having;

(1) a push-button;

(2) a truncated-conical-rod-push-plunger;

(3) a rod;

(4) a return-coil-spring;

(5) a receiver-dispenser-plunger; and (6) a guide pin which operates in combination with said return-coil-spring for guiding said rod when retracting and advancing;

b) wherein said insertion assembly comprises said inserter body and said spring assembly in combination, said spring assembly housed by said inserter body;

c) wherein said inserter body comprises said an ear-canal-shaped body having said proximate end and said distal end on opposing ends of said ear-canal-shaped body;

d) wherein said linear-semicircular-cross-sectioned-microphone-wire-inserter-slot is located on said distal end of said ear-canal-shaped body;

e) wherein said linear-semicircular-cross-sectioned-microphone-wire-inserter-slot comprises a linear-slot that runs perpendicular to a receiver-dispenser aperture and allows a microphone wire to extend therefrom;

f) wherein said distal end terminates in said receiver-dispenser aperture;

g) wherein said ear-canal-shaped body comprises a channel for guiding said receiver-in-the-canal hearing instrument to be inserted into an ear canal via a linear mechanical movement;

h) wherein said receiver-in-the-canal hearing instrument is able to be substantially isolated from contamination of hands of a user before said receiver-in-the-canal hearing instrument is inserted into the ear canal;

i) wherein said ear-canal-shaped body nearest said distal end comprises a taper;

j) wherein said taper is contoured to match the ear canal;

k) wherein said receiver-dispenser aperture is about ⅜ inch wide;

l) wherein said ear-canal-shaped body comprises a body-length of about 5 inches;

m) wherein said rod comprises a rod-length of about 5 inches;

n) wherein said rod comprises a diameter of about ⅛ inch;

o) wherein said rod is solid and cylindrical;

p) wherein said proximate end comprises a through-hole;

q) wherein said push-button is depressible through said through-hole, said pushbutton constrained from uncoupling from said spring assembly within inserter body via said annular push-button-restraining-lip;

r) wherein said interior volume comprises and contains said first truncated-conical-rod-push-plunger, said rod, said return-coil-spring, and said second receiver-dispenser-plunger;

s) wherein said push-button is depressible to initiate a mechanical series reaction from said push-button to said first truncated-conical-rod-push-plunger to said rod, said first truncated-conical-rod-push-plunger pushing said rod, said rod compressing said return-coil-spring, said return-coil-spring compressed to move said second receiver-dispenser-plunger towards said receiver-dispenser aperture in said distal end;

t) wherein said second receiver-dispenser-plunger temporarily holds a receiver-in-the-canal hearing instrument and inserts it into the ear canal through said receiver-dispenser aperture when said push-button is depressed;

u) wherein said push-button when released allows said return-coil-spring to return to a tension state allowing said second receiver-dispenser-plunger, said rod, said first truncated-conical-rod-push-plunger to travel back towards said proximate end after said receiver-in-the-canal hearing instrument is inserted into the ear canal; and v) wherein said insertion assembly is useful to allow the user to insert said receiver-in-the-canal hearing instrument into the ear canal in a controlled fashion.

15. A method of using a push button insertion tool comprising the steps of:

a) placing a receiver-in-the-canal hearing instrument into a second receiver-dispenser-plunger;

b) inserting an inserter body into an ear canal;

c) depressing a push-button to push a first truncated-conical-rod-push-plunger, a rod, compress a return-coil-spring and push a second receiver-dispenser-plunger in series, said second receiver-dispenser-plunger holding said receiver-in-the-canal hearing instrument; and d) inserting said receiver-in-the-canal hearing instrument into the ear canal.

16. The method of claim 15 further comprising the step of draping a microphone wire through a linear-semicircular-cross-sectioned-microphone-wire-inserter-slot in said ear-canal-shaped body.

17. The method of claim 15 further comprising the step of sanitizing said receiver-in-the-canal hearing instrument before said placing step.

* * * * *